US007355566B2

(12) United States Patent
Mizuta

(10) Patent No.: US 7,355,566 B2
(45) Date of Patent: Apr. 8, 2008

(54) PLASMA DISPLAY PANEL AND DRIVING METHOD THEREOF

(75) Inventor: Takahisa Mizuta, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 662 days.

(21) Appl. No.: 10/996,933

(22) Filed: Nov. 22, 2004

(65) Prior Publication Data

US 2005/0122286 A1 Jun. 9, 2005

(30) Foreign Application Priority Data

Nov. 29, 2003 (KR) ..... 10-2003-0086109

(51) Int. Cl.
*G09G 3/28* (2006.01)

(52) U.S. Cl. ..... 345/60; 345/66

(58) Field of Classification Search ..... 345/60–77; 315/169.1, 169.2, 169.3, 169.4; 313/582, 313/584, 586, 574, 633
See application file for complete search history.

(56) References Cited

U.S. PATENT DOCUMENTS

| | | | | |
|---|---|---|---|---|
| 6,781,322 | B2 * | 8/2004 | Onozawa et al. | 315/169.3 |
| 6,954,035 | B2 * | 10/2005 | Chien et al. | 315/169.4 |
| 2004/0104869 | A1 * | 6/2004 | Jeong | 345/60 |
| 2004/0125051 | A1 * | 7/2004 | Hirakawa et al. | 345/63 |
| 2004/0252080 | A1 * | 12/2004 | Marcotte et al. | 345/60 |

* cited by examiner

*Primary Examiner*—Nitin I. Patel
(74) *Attorney, Agent, or Firm*—Christie, Parker & Hale, LLP

(57) ABSTRACT

A PDP driving method. A first sustain discharge pulse is applied to a Y electrode of the PDP during a sustain period, and a stabilization pulse is applied to the Y electrode before a second sustain discharge pulse is applied to the X electrode. Accordingly, amounts of wall charges and space charges after the first sustain discharge are controlled, and the second and subsequent sustain discharges are stably generated.

12 Claims, 6 Drawing Sheets

PLASMA DISPLAY PANEL AND DRIVING METHOD THEREOF

CROSS REFERENCE TO RELATED APPLICATION

This application claims priority to and the benefit of Korea Patent Application No. 10-2003-0086109 filed on Nov. 29, 2003 in the Korean Intellectual Property Office, the entire content of which is incorporated herein by reference.

BACKGROUND OF THE INVENTION (a) Field of the Invention

The present invention relates to a plasma display panel (PDP) driving method. More specifically, the present invention relates to a PDP driving method for improving efficiency of a sustain discharge.

(b) Description of the Related Art

Recently, liquid crystal displays (LCDs), field emission displays (FEDs), and plasma displays have been actively developed. Plasma displays have better luminance and light emission efficiency compared to other types of flat panel devices, and they also have wider view angles. Therefore, the plasma displays have come into the spotlight as substitutes for the conventional cathode ray tubes (CRTs) in large displays of greater than 40 inches.

The plasma display is a flat display that uses plasma generated via a gas discharge process to display characters or images, and tens to millions of pixels are provided thereon in a matrix format, depending on its size. Plasma displays are categorized into DC plasma displays and AC plasma displays, according to supplied driving voltage waveforms and discharge cell structures.

Since the DC plasma displays have electrodes exposed in the discharge space, they allow a current to flow in the discharge space while the voltage is supplied, and therefore they problematically require resistors for current restriction. On the other hand, since the AC plasma displays have electrodes covered by a dielectric layer, capacitances are naturally formed to restrict the current, and the electrodes are protected from ion shocks in the case of discharging. Accordingly, they have a longer lifespan than the DC plasma displays.

FIG. 1 shows a perspective view of an AC PDP. As shown, scan electrode 4 and sustain electrode 5, disposed over dielectric layer 2 and protection film 3, are provided in parallel and form a pair with each other under first glass substrate 1. A plurality of address electrodes 8 covered with insulation layer 7 are installed on second glass substrate 6. Barrier ribs 9 are formed in parallel with address electrodes 8, on insulation layer 7 between address electrodes 8, and phosphor 10 is formed on the surface of insulation layer 7 between barrier ribs 9. First and second glass substrates 1, 6 having a discharge space 11 between them are provided facing each other so that the scan electrode 4 and sustain electrode 5 may respectively cross address electrode 8. Address electrode 8 and discharge space 11 formed at a crossing point of scan electrode 4 and sustain electrode 5 form a discharge cell 12.

FIG. 2 shows a PDP electrode arrangement diagram. As shown, the PDP electrode has an m×n matrix configuration, and in more detail, it has address electrodes A1 to Am in a column direction, and scan electrodes Y1 to Yn and sustain electrodes X1 to Xn in a row direction, alternately. The scan electrodes will be referred to as Y electrodes and the sustain electrodes as X electrodes hereinafter. Discharge cell 12 shown in FIG. 2 corresponds to discharge cell 12 shown in FIG. 1.

FIG. 3 shows a conventional PDP driving waveform diagram. Each subfield according to the conventional PDP method shown in FIG. 3 includes a reset period, an address period, and a sustain period. The reset period erases wall charge states of a previous sustain, and sets up the wall charges in order to stably perform a next address. In the address period, the panel cells that are turned on and the cells that are not turned on are selected, and wall charges are accumulated to the cells that are turned on (i.e., the addressed cells). In the sustain period, discharge for actually displaying pictures on the addressed cells is performed by alternately applying a sustain discharge pulse Vs to the X and Y electrodes.

The wall charges represent the charges that are formed on the wall (e.g., a dielectric layer) of the discharge cell near each electrode and are accumulated on the electrode. The wall charges are not actually contacted with the electrode, but they are depicted to be "formed," "accumulated," and "piled" on the electrode. Also, the wall voltage represents a potential difference formed on the wall of the discharge cell by the wall charges.

When the reset period is terminated in the conventional driving waveform, weak negative charges are stored on the Y electrode, and weak positive charges are stored on the X electrode. That is, a voltage difference corresponding to a discharge firing voltage Vf is maintained between the X and Y electrodes in the discharge cell when an ideal reset operation is performed.

After this, the positive charges are stored on the Y electrode and the negative charges are stored on the X electrode since a low voltage of 0V is applied to the Y electrode of the discharge cell selected in the address period and a high voltage Ve which is greater than the voltage applied to the Y electrode is applied to the X electrode.

The wall charges and priming particles are gradually reduced as the address operation proceeds on all the Y electrodes in the address period. As a result, insufficient wall charges are stored on the X and Y electrodes after a first sustain discharge pulse Vs is applied to the Y electrode to generate a discharge between the X and Y electrodes, and hence, no stable discharge is generated between the X and Y electrodes when a second sustain discharge pulse is applied to the X electrode.

SUMMARY OF THE INVENTION

In accordance with the present invention a PDP driving method is provided for generating stable discharges and improving operational margins.

In one aspect of the present invention, a method for driving a PDP having a plurality of first electrodes and second electrodes, includes: in an initial part of a sustain period, (a) applying a first voltage pulse having a first voltage to the first electrode; (b) then applying at least one second voltage pulse having a voltage less than the first voltage to the first electrode; and (c) then applying a third voltage pulse having the first voltage to the second electrode.

The second voltage pulse has a second voltage level for a predetermined period.

The second voltage pulse may gradually rise to a second voltage level such as a ramp waveform which linearly rises, or may be a round waveform which curvedly rises.

The second voltage pulse may be superimposed on the first voltage pulse for a predetermined time.

The second electrode is maintained at a reference voltage level when applying the first voltage pulse having the first voltage to the first electrode and when applying at the least one second voltage pulse having the voltage less than the first voltage to the first electrode, and a voltage difference between the second voltage level and the reference voltage level is provided within a range for generating a discharge between the first and second electrodes.

In another aspect of the present invention, a PDP comprises: a first substrate and a second substrate facing with each other with a gap therebetween; a plurality of address electrodes arranged on the first substrate; a plurality of first electrodes and second electrodes arranged to cross the address electrodes on the second substrate; and a driving circuit for transmitting driving signals to the first, second, and address electrodes during a reset period, an address period, and a sustain period. The driving circuit, in an initial part of the sustain period, applies a first voltage pulse having a first voltage to the first electrode and applies a second voltage pulse with a second voltage while the voltage at the second electrode is maintained at a reference voltage, and the same applies a third voltage pulse having the first voltage to the second electrode while the voltage at the first electrode is maintained at the reference voltage.

The third voltage pulse may be a square waveform with the third voltage level, or a waveform which gradually rises to the third voltage level, and the third voltage pulse may be superimposed on the second voltage pulse for a predetermined time.

DETAILED DESCRIPTION

Figure 1:
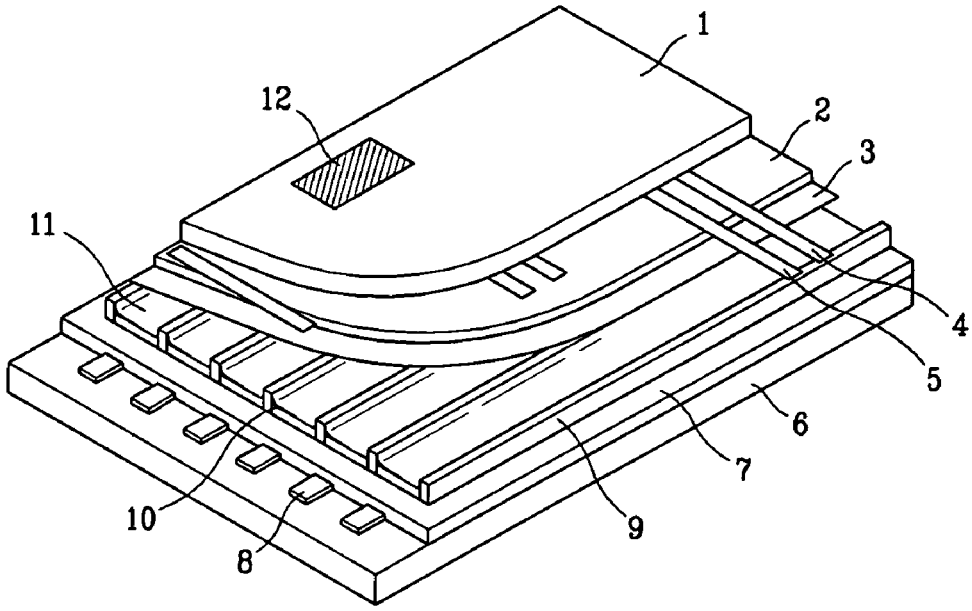
FIG. 1 (Prior Art)
FIG. 1 shows a partial perspective view of a conventional AC PDP.
Figure 2:
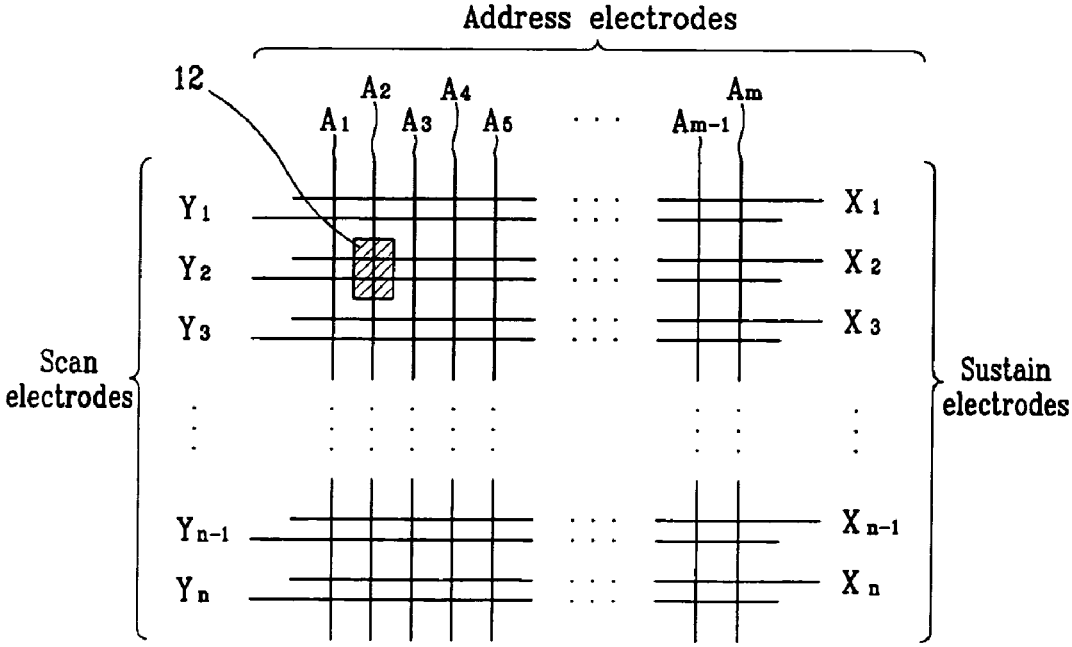
FIG. 2 (Prior Art)
FIG. 2 shows a conventional PDP electrode arrangement diagram.
Figure 3:
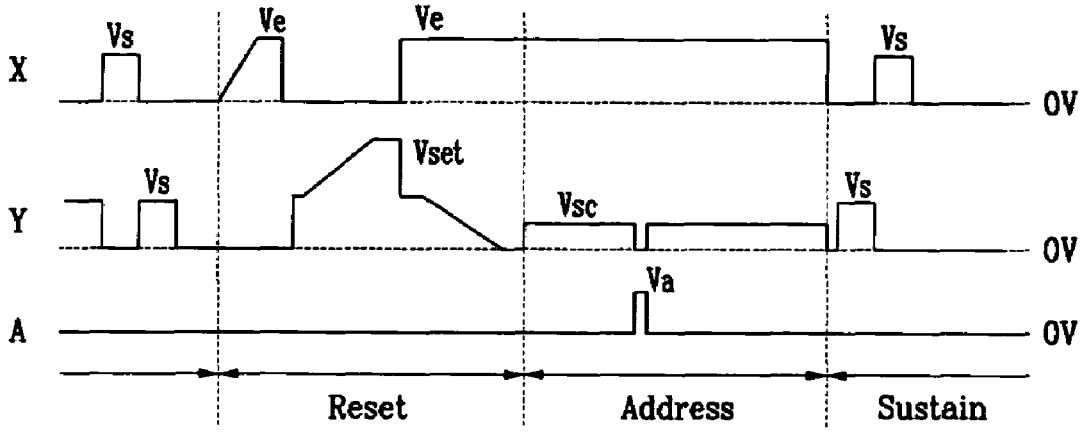
FIG. 3(Prior Art)
FIG. 3 shows a conventional PDP driving waveform diagram.
Figure 4:
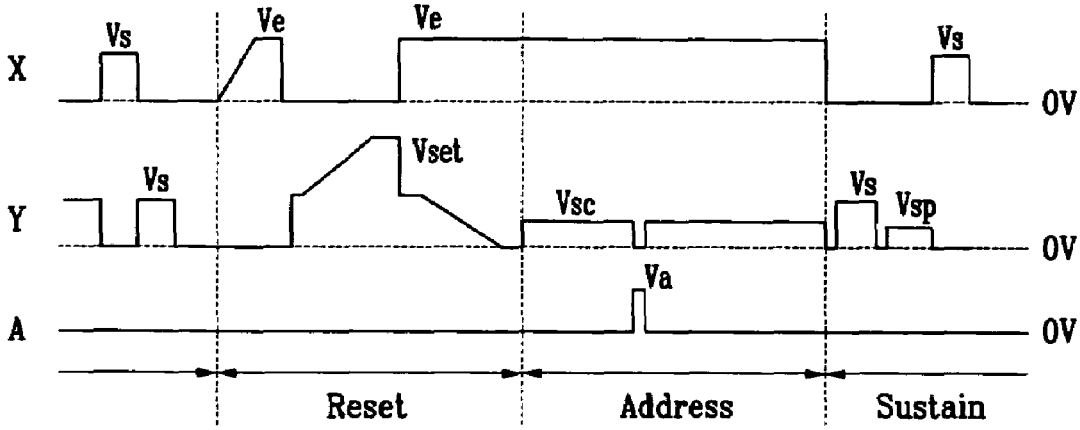
FIG. 4 shows a PDP driving waveform diagram according to a first exemplary embodiment of the present invention.

A PDP driving method will now be described in detail with reference to drawings. As shown in FIG. 4, during the sustain period, after a first sustain discharge plus Vs is applied to the Y electrode, stabilization pulse Vsp for stabilizing a discharge is applied to the Y electrode before a second sustain discharge pulse Vs is applied to the X electrode.

During the address period, a scan pulse of 0V is applied to the Y electrode, address pulse Va is applied to address electrode A, and voltage Ve is applied to the X electrode. In this instance, an address discharge is generated at a discharge cell which is formed by the Y electrode to which the scan pulse is applied and address electrode A to which the address pulse is applied. The wall charges are formed at the discharge cell because of the address discharge.

During the sustain period, sustain discharge pulse Vs is applied to the Y electrode. A discharge is generated at the discharge cell on which the wall charges are formed in the address period by the first sustain discharge pulse, and the wall charge state is modified. The modified wall charge state represents a state in which a sustain discharge can be subsequently generated by the second sustain discharge pulse applied to the X electrode. No discharge is generated by the first sustain discharge pulse at the discharge cell on which no address discharge is generated in the address period, and accordingly, no sustain discharge is generated when a sustain discharge pulse is subsequently applied.

It is insufficient for the wall charges formed at the X and Y electrodes to be sustain-discharged by the second sustain discharge pulse after the first sustain discharge pulse in the discharge cell from which part of the wall charges formed in the address period is quenched.

Therefore, as shown in FIG. 4, stabilization pulse Vsp is applied to the Y electrode after the first sustain discharge pulse. Space charges generated by the first sustain discharge pulse are moved to the X and Y electrodes and are then piled up by the stabilization pulse Vsp. Therefore, a stable discharge is generated when the second sustain discharge pulse is applied.

Referring to FIGS. 4 and 5A to 5D, a discharge process at the discharge cell to which the address pulse and the scan pulse are applied and which is then selected will now be described in more detail. For ease of description, a single discharge cell including an X electrode, a Y electrode, and an address electrode A to which voltage Ve, a scan pulse, and an address pulse are applied is illustrated in the drawings.

Referring to FIG. 4, voltage Ve is applied to the X electrode, a scan pulse of 0V is applied to the Y electrode, and address pulse voltage Va is applied to address electrode A in the address period. Voltage Ve at the sustain electrode and voltage Va at address electrode A are higher than the reference voltage (0V). Voltage Va is a voltage which can generate a surface discharge between address electrode A and the Y electrode because of a voltage difference between voltage Va and voltage Vsc, and a difference between address voltage Ve and the scan voltage of 0V is lower than the discharge firing voltage between the X and Y electrodes.

Figure 5A:
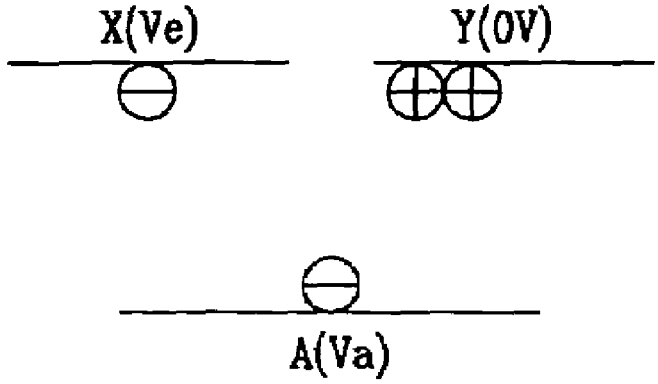
FIGS. 5A to 5D show wall charge distribution diagrams according to the driving waveform of FIG. 4.

Accordingly, a discharge is generated between address electrode A and the Y electrode because of the voltage difference between voltage Va at address electrode A and the voltage of 0V at the Y electrode, and a discharge is generated between the Y and X electrode by priming the discharge of between address electrode A and the Y electrode. As shown in FIG. 5A, the negative charges are accumulated on address electrode A and the X electrode, and the positive charges are accumulated on the Y electrode.

Figure 5B:
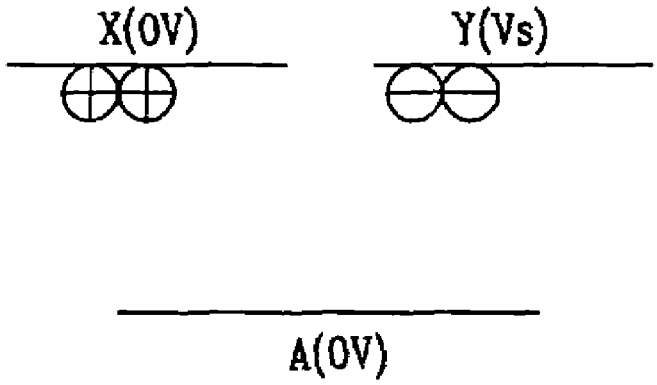

Referring to FIGS. 4 and 5B, first sustain discharge pulse Vs is applied to the Y electrode, and the reference voltage of 0V is applied to the X electrode and address electrode A. When sustain discharge pulse Vs is applied, discharges are mainly generated between the X and Y electrodes because of the wall voltage caused by the wall charges of the X and Y electrodes and voltage Vs of the sustain discharge pulse. In this instance, a greater amount of negative charges than the negative charges formed in the address period is formed by the sustain discharge pulse of the higher voltage, and the positive charges and the negative charges are respectively accumulated on the X and Y electrodes as shown in FIG. 5B.

Figure 5C:
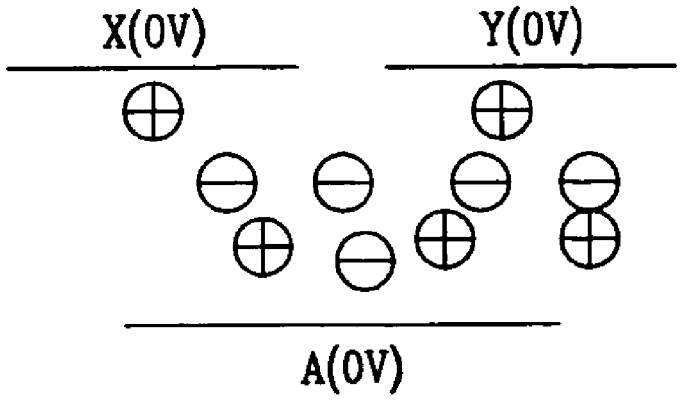
Figure 5D:
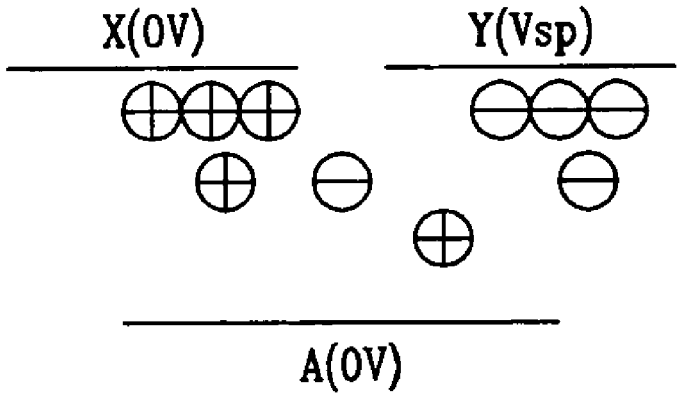

When the first sustain discharge pulse applied to the Y electrode declines, a self discharge is generated between the X and Y electrodes by the wall charges accumulated on the X and Y electrode, and space charges are formed in the discharge cell by the self discharge as shown in FIG. 5C.

Next, stabilization pulse voltage Vsp is applied to the Y electrode of the discharge cell having the space charges thereon while the reference voltage of 0V is applied to the X electrode. Therefore, the negative charges from among the space charges generated by the first sustain discharge pulse are moved to the Y electrode which has a relatively higher voltage, and the positive charges are moved to the X electrode as given in FIG. 5D.

After this, the second sustain discharge pulse with voltage Vs is applied to the X electrode of the discharge cell on which the wall charges are the space charges are formed, and the reference voltage of 0V is applied to the Y electrode. In this instance, the space charges function as priming particles and reduce the voltage for firing a sustain discharge. Accordingly, when voltage Vs which is lower than discharge firing voltage Vf is applied while the space charges remains in the discharge cell, the effective voltage formed by the space charges and voltage Vs exceeds discharge firing voltage Vf to generate a stable sustain discharge.

In this instance, the amounts of the wall charges and the space charges can be appropriately controlled by controlling the width of the stabilization pulse, the voltage, and the application time. That is, the amount of the space charges is reduced since the amount of wall charges is increased when the width of the stabilization pulse is increased. In a like manner, the amount of the space charges is reduced since the amount of wall charges is increased when the voltage of the stabilization pulse is increased. Further, the closer the time for applying the stabilization pulse approaches the first sustain discharge pulse, the more wall charges are accumulated.

Also, it is desirable to differently establish the width of the stabilization pulse, the voltage, and the application time depending on the PDP features.

According to the first exemplary embodiment, the stability of the second sustain discharge is improved since the amounts of the wall charges and the space charges after the first sustain discharge are controlled by the stabilization pulse inserted and applied between the first and second sustain discharge pulses.

Voltage Vsp in square wave format is used as the stabilization pulse in the first exemplary embodiment, and other waveforms can also be used, which will now be described with reference to FIGS. 6 and 7, which respectively show a PDP driving waveform diagram according to second and third exemplary embodiments of the present invention.

Figure 6:
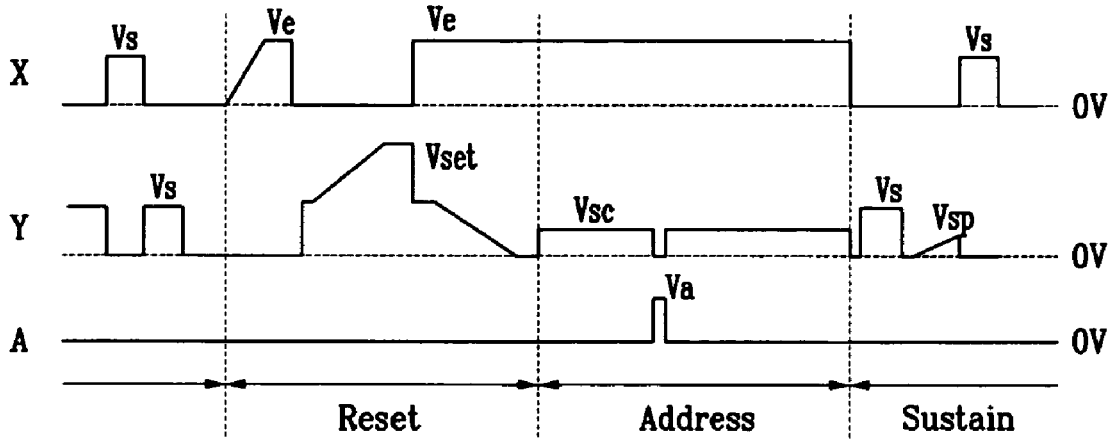
FIG. 6 shows a PDP driving waveform diagram according to a second exemplary embodiment of the present invention.

Referring to FIG. 6, the stabilization pulse in the driving waveform according to the second embodiment is a ramp waveform which gradually increases from 0V to voltage Vsp. When the voltage applied to the Y electrode gently rises to voltage Vsp, a discharge is generated between the Y and X electrodes, and wall charges are accumulated on the Y and X electrodes. When the ramp waveform falls to the 0V reference voltage, a self discharge is generated by the wall charges accumulated on the Y and X electrodes, and the space charges are formed in the discharge cell.

Figure 7:
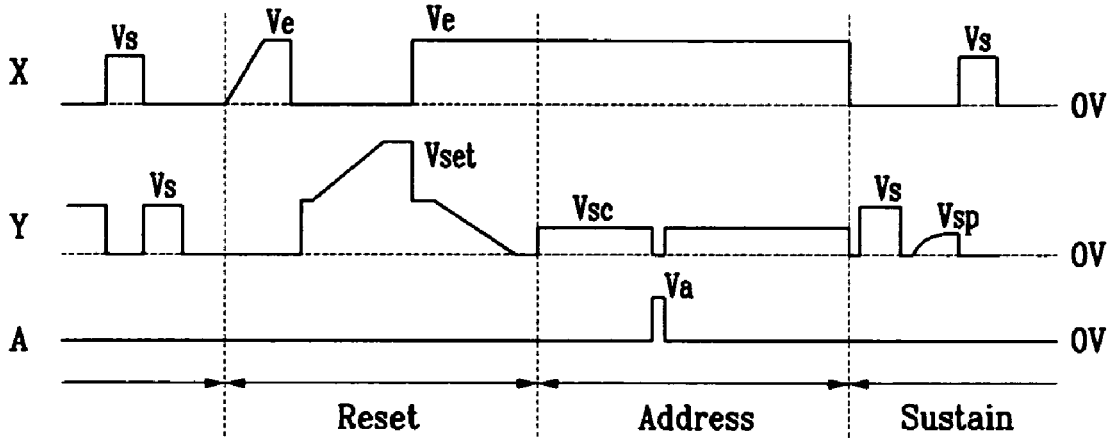
FIG. 7 shows a PDP driving waveform diagram according to a third exemplary embodiment of the present invention.

As shown in FIG. 7, the stabilization pulse in the driving waveform according to the third embodiment is a round waveform which increases curvedly. Since the discharge phenomenon according to the round waveform is similar to that of the ramp waveform of FIG. 6, no corresponding description will be provided.

The stabilization pulse has been applied between the first and second sustain discharge pulses in the first to third embodiments. The stabilization pulse can also be applied so that the first sustain discharge pulse and the stabilization pulse may be superimposed, which will now be described with reference to FIG. 8.

Figure 8:
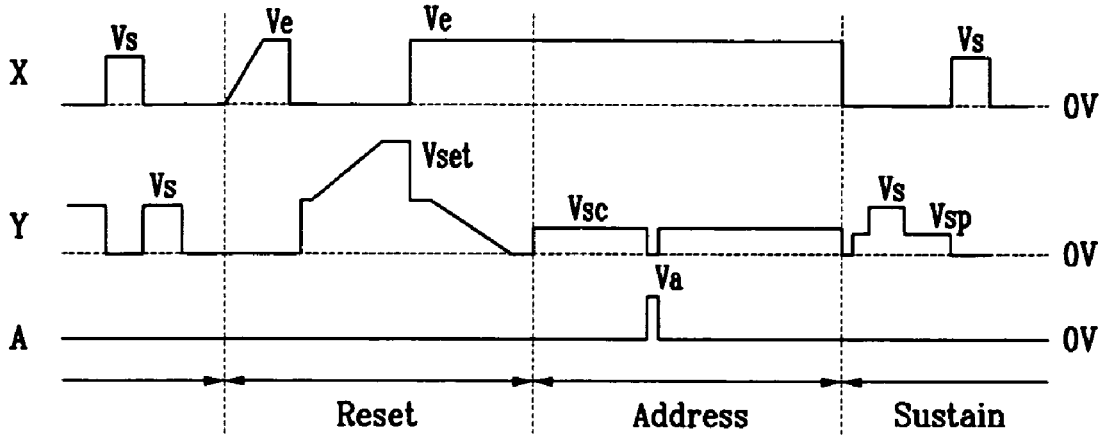
FIG. 8 shows a PDP driving waveform diagram according to a fourth exemplary embodiment of the present invention.

FIG. 8 shows a PDP driving waveform diagram according to a fourth exemplary embodiment of the present invention. As shown, the first sustain discharge pulse is applied while the stabilization pulse is applied to the Y electrode in the sustain period in the fourth embodiment. The stabilization pulse and the first sustain discharge pulse are superimposed for a predetermined time, and since the stabilization pulse is consecutively applied to the Y electrode for a predetermined time after the first sustain discharge pulse has been applied, the amounts of the wall charges and the space charges after the first sustain discharge can be controlled in like manners of the first to third embodiments of the present invention.

In this instance, it is desirable to appropriately establish the voltage of the stabilization pulse so that no discharge may occur because of the voltage of the stabilization pulse applied before the first sustain discharge pulse is applied.

Figure 9:
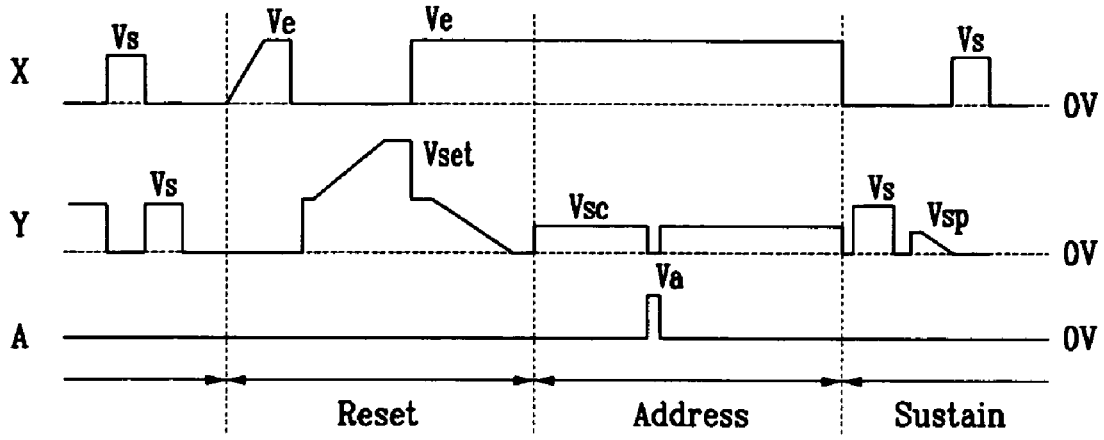
FIG. 9 shows a PDP driving waveform diagram according to a fifth exemplary embodiment of the present invention.

Also, the waveform which is reduced in the ramp format after the first sustain discharge pulse is applied can be applied as shown in FIG. 9 as the stabilization pulse of the driving waveform according to the fifth embodiment.

The first to fifth embodiments have been described with respect to a reference (or ground) potential of 0V, and without being restricted to them, pulses with other voltage levels can be used for the same discharge characteristics.

According the present invention, since it is possible to control the amounts of wall charges and space charges by applying a first sustain discharge pulse to the Y electrode, then applying a stabilization pulse to the Y electrode before applying a second sustain discharge pulse to the X electrode during the sustain period. Further, the amounts of wall charges and space charges after the first sustain discharge can be controlled by controlling the voltage of the stabilizing pulse, the width, and the application time according to the PDP characteristics.

While this invention has been described in connection with what is presently considered to be practical embodiments, it is to be understood that the invention is not limited to the disclosed embodiments, but, on the contrary, is intended to cover various modifications and equivalent arrangements included within the spirit and scope of the appended claims.

What is claimed is:

1. A plasma display panel comprising:

a first substrate and a second substrate facing with each other with a gap therebetween;

a plurality of address electrodes arranged on the first substrate;

a plurality of first electrodes and second electrodes arranged to cross the address electrodes on the second substrate; and a driving circuit for transmitting driving signals to the first, second, and address electrodes during a reset period, an address period, and a sustain period, wherein the driving circuit, in an initial part of the sustain period, applies a first voltage pulse having a first voltage to the first electrode and applies a second voltage pulse with a second voltage while the voltage at the second electrode is maintained at a reference voltage, and applies a third voltage pulse having the first voltage to the second electrode while the voltage at the first electrode is maintained at the reference voltage.

2. The plasma display panel of claim 1, wherein the first voltage pulse and the third voltage pulse have square waveforms.

3. The plasma display panel of claim 1, wherein the second voltage pulse has a waveform which gradually rises to the third voltage level.

4. The plasma display panel of claim 1, wherein the second voltage pulse is superimposed on the first voltage pulse for a predetermined time.

5. A method for driving a plasma display panel including a plurality of first electrodes and second electrodes, comprising:

in an initial part of a sustain period, (a) applying a first voltage pulse having a first voltage to the first electrode;

(b) then applying at least one second voltage pulse having a voltage less than the first voltage to the first electrode; and (c) then applying a third voltage pulse having the first voltage to the second electrode.

6. The method of claim 5, wherein the second voltage pulse has a second voltage level for a predetermined period.

7. The method of claim 5, wherein the second voltage pulse gradually rises to a second voltage level.

8. The method of claim 7, wherein the second voltage pulse has a ramp waveform which linearly rises.

9. The method of claim 7, wherein the second voltage pulse has a round waveform which curvedly rises.

10. The method of claim 5, wherein the second voltage pulse is superimposed on the first voltage pulse for a predetermined time.

11. The method of claim 5, wherein the second electrode is maintained at a reference voltage level when applying the first voltage pulse having the first voltage to the first electrode and when applying the at least one second voltage pulse having the voltage less than the first voltage to the first electrode.

12. The method of claim 11, wherein a voltage difference between the second voltage level and the reference voltage level is provided within a range for generating a discharge between the first and second electrodes.

* * * * *